US005566903A

United States Patent [19]

Meltzer

[11] Patent Number: 5,566,903

[45] Date of Patent: Oct. 22, 1996

[54] ROLLER MILL FOR MILLING SUSPENDED FIBROUS MATERIAL

[75] Inventor: Frank P. Meltzer, Daisendorf, Germany

[73] Assignee: Sulzer-Escher Wyss GmbH, Ravensburg, Germany

[21] Appl. No.: 327,787

[22] Filed: Oct. 20, 1994

[30] Foreign Application Priority Data

Nov. 6, 1993 [DE] Germany ..... 43 37 998.2

[51] Int. Cl.[6] ..... B02C 7/02; B02C 7/12

[52] U.S. Cl. ..... 241/261.2; 241/296

[58] Field of Search ..... 241/259.1, 259.2, 241/261.1, 261.2, 261.3, 296, 297, 298

[56] References Cited

U.S. PATENT DOCUMENTS

| | | | |
|---|---|---|---|
| 199,070 | 1/1878 | Jaquett | 241/261.1 |
| 277,578 | 5/1883 | Kinkead | 241/261.2 |
| 878,693 | 2/1908 | Vessot | 241/297 X |
| 1,184,058 | 5/1916 | Watson | 241/261.1 |
| 1,369,685 | 2/1921 | Maloney | 241/261.3 |
| 1,593,854 | 7/1926 | Snyder | 241/261.1 |
| 1,851,071 | 3/1932 | Travis | 241/261.1 X |
| 3,448,934 | 6/1969 | Vaughan . | |
| 4,081,147 | 3/1978 | Seifert et al. . | |
| 4,171,101 | 10/1979 | Seifert et al. . | |
| 4,395,047 | 7/1983 | Lahner, III . | |
| 4,614,309 | 9/1986 | Goldenberg | 241/261.2 X |
| 5,200,038 | 4/1993 | Brown | 241/261.2 X |
| 5,398,877 | 3/1995 | Xiangzhi | 241/297 X |

FOREIGN PATENT DOCUMENTS

| | | | |
|---|---|---|---|
| 2352917 | 12/1977 | France . | |
| 14965 | 1/1881 | Germany | 241/297 |
| 1796964 | 8/1959 | Germany . | |
| 4217316 | 11/1993 | Germany . | |
| 137397 | 2/1960 | U.S.S.R. | 241/261.1 |
| 1058603 | 12/1983 | U.S.S.R. | 241/261.2 |
| 596039 | 12/1947 | United Kingdom | 241/297 |

OTHER PUBLICATIONS

German Office Action.
European Search Report and Annex.
European Search Report.

*Primary Examiner*—Timothy V. Eley
*Attorney, Agent, or Firm*—Greenblum & Bernstein P.L.C.

[57] ABSTRACT

Roller mill and milling tool for milling suspended fibrous material. For particularly economical milling of suspended fibrous materials, roller mills and milling tools are utilized in which the radial extent of the working surfaces deviate from the state of the art in that the raised areas, acting in the manner of knives, form working surfaces which extend radially outwardly to a lesser extent than the base surfaces of the milling tools or the corresponding milling tool carriers, whereby it is feasible to utilize the shorter raised areas on the stator side, the rotor side, or on both sides, thereby, via these measures, achieving a particularly economical and uniform comminution.

12 Claims, 2 Drawing Sheets

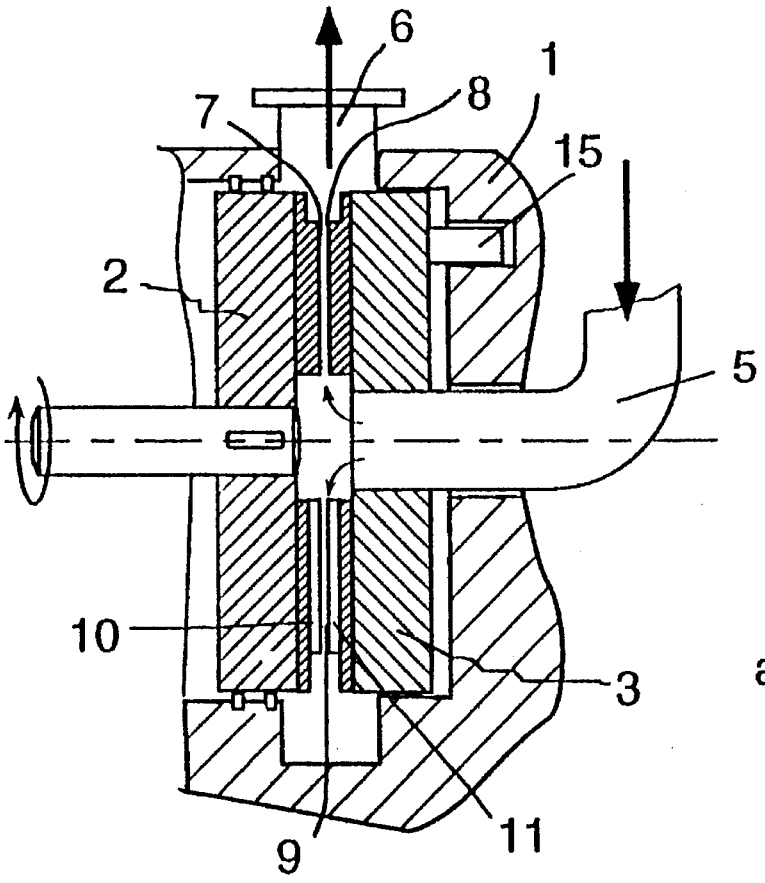
Fig.1
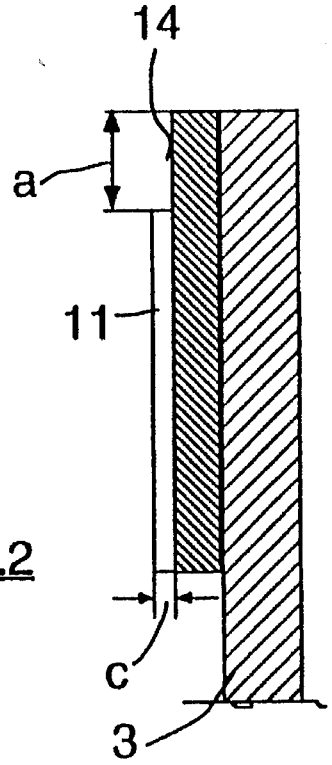
Fig.2
Fig.3
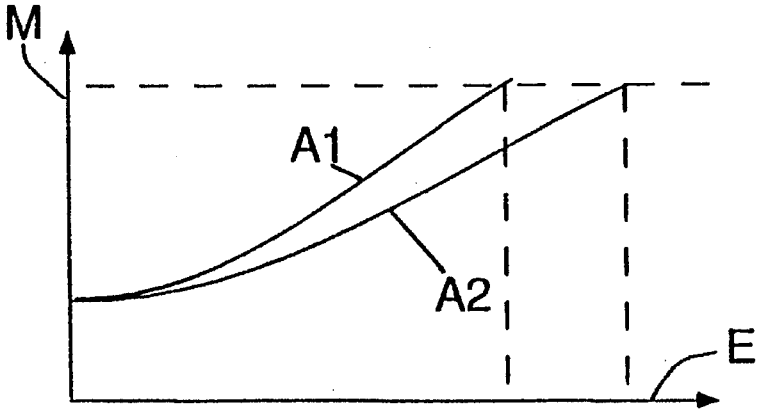

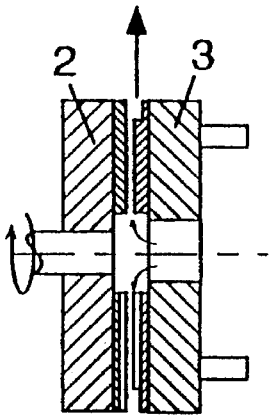
Fig.4
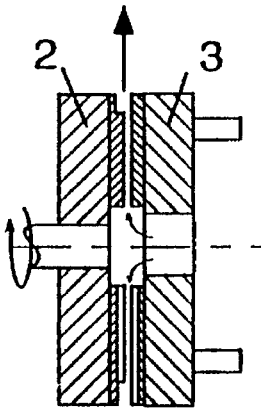
Fig.5
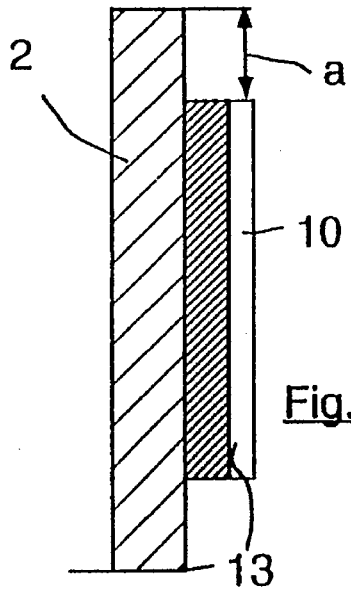
Fig.6
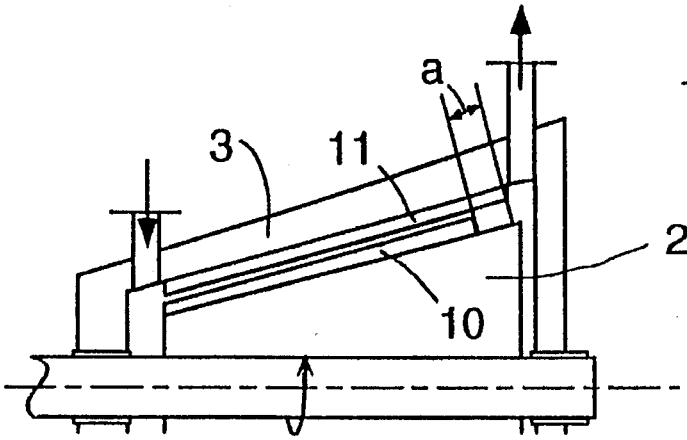
Fig.7
Fig.8
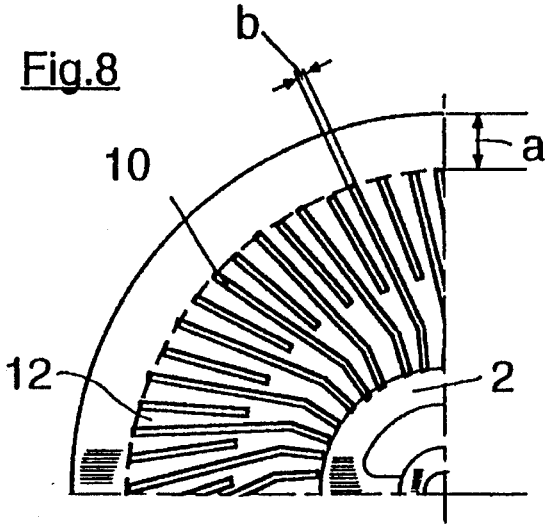
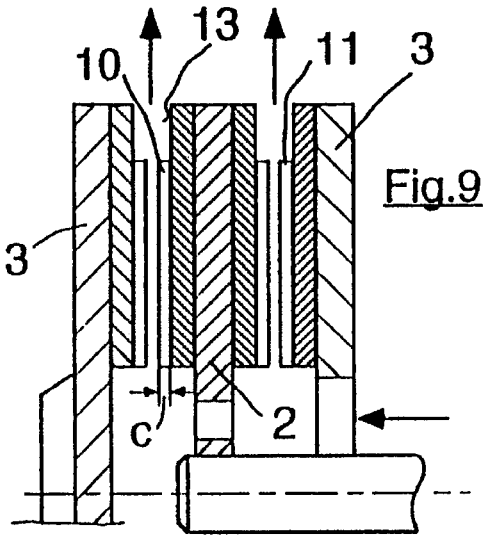
Fig.9

ROLLER MILL FOR MILLING SUSPENDED FIBROUS MATERIAL

CROSS REFERENCE TO RELATED APPLICATIONS

This application claims the priority of German Patent Application No. DE P 43 37 998.2, filed Nov. 6, 1993, the disclosure of which is incorporated herein by reference in its entirety.

BACKGROUND OF THE INVENTION

1. Field of the Invention

The invention pertains to devices, such as milling tools and/or a roller mill, for grinding or comminuting fiber or fibrous material wherein the milling tools comprise at least one pair of opposed relatively movable and substantially rotationally symmetrical milling tool carriers, including a rotor and a stator, upon which carriers the milling tools are so attachable in pairs and that the milling tools form least one pair of complementary working surfaces; the working surfaces in turn forming a milling aperture, with the fibrous material flowing through the milling aperture during the operation of the roller mill; and the working surface of at least one milling tool, on the side facing the fibrous material, during operation, including above base surface of he working surfaces, a plurality of raised areas acting in the manner of knives, with the raised areas having channel shaped slots so that the fibrous material can at least be partially directed through the slot from the inside to the outside thereof, with a mechanical working of the fibrous material being achieved via the relative motion between the complementary working surfaces.

2. Discussion of the Background of the Invention and Material Information

Milling tools of the previously described type which are also often denominated as garnitures, are incorporated in roller mills that are also often denominated as refiners. Such roller mills include at least one rotor and at least one stator with either disk-shaped or conically formed surfaces which are adapted to receive the milling tools or garnitures in a manner so as that a milling or comminution aperture is formed therebetween. The milling tools under consideration here include webs or fillets and slots or grooves at the working surfaces and are thus also referred to as "knife garnitures".

A substantial part of the operating costs incurred in the grinding or comminution of fiber or fibrous materials in the wood pulp, cellulose, and paper industry are due to energy costs. Thus, it has always been an endeavor to build and operate devices of this type which, as measured relative to the desired result, do not require excessive energy utilization. Since the targets of fibrous material treatment differ, depending upon the application situation, the judgment or evaluation of the milling effect also differs. In many instances the utilized energy is so referred to the milling result in that either the amount per ton of fibrous material and the increase in the degree of fineness or the kilowatt hour per ton of fibrous material and the increase in the fiber strength is stated. The compatibility of such values however otherwise requires the same operating conditions. In particular, it is not possible to lower the grinding costs in that while lower energy is utilized, on the other hand, even with a sufficient increase in the degree of fineness, the treated fibrous material no longer meets quality requirements.

SUMMARY OF THE INVENTION

It is the task or object of this invention to produce devices of the previously described type in which the energy utilized for grinding, for achieving the desired milling result, is less than the energy that is currently required.

One embodiment of this invention pertains to a roller mill for the milling of fibrous materials, wherein the roller mill comprises a housing having inlet and outlet openings for the fibrous material; at least two complementary milling tool carriers, including a rotor and a stator, for the attachment of milling tools for establishing at least one working surface and a complementary additional working surface, with the working surfaces being positioned, relative to each other, so as to define a milling aperture through which the fibrous material flows during the operation of the roller mill; at least one of the working surfaces including a plurality of raised areas acting in the manner of knives and having channel shaped grooves therebetween, so that the fibrous material is at least partially directed through the channel shaped grooves from the inside to the outside thereof, with a mechanical working of the fibrous material being achieved via the relative motion between the two complementary working surfaces; and on at least one side of the milling aperture, the raised areas of the at least one working surface extending radially outwardly at least 30 mm less than its associated milling tool carrier.

In a variation of the previous embodiment, the lesser extent which the raised areas of the at least one working surface extend radially outwardly, is equal to or greater than 10% of the radial distance between the centers of the milling tool carriers and the outer diameter of the at least one working surface.

In another variation of the previous embodiment, the mutually complementary milling tool tarriers are substantially disk shaped.

In a further variation of the previous embodiment, the mutually complementary milling tool carriers have a substantially truncated cone shape.

A second embodiment of this invention pertains to milling tools for milling suspended fibrous materials in a roller mill, wherein the milling tools comprise at least one pair of opposed relatively movable and substantially rotationally symmetrical milling tool carriers, including a rotor and a stator, upon which carriers the milling tools are so attachable in pairs and that the milling tools form at least one pair of complementary working surfaces; the working surfaces in turn forming a milling aperture , with the fibrous material flowing through the milling aperture during the operation of the roller mill; the working surface of at least one milling tool, on the side facing the fibrous material, during operation, including above base surfaces of the working surfaces, a plurality of raised areas acting in the manner of knives, with the raised areas having channel shaped slots so that the fibrous material can at least be partially directed through the slots from the inside to the outside thereof, with a mechanical working of the fibrous material being achieved via the relative motion between the complementary working surfaces and; the raised areas of the working surfaces extending radially outwardly at least 30 mm less outwardly than the base surfaces of the milling tool.

In a variation of the second embodiment, the lesser extent which the raised areas of the working surfaces extend radially outwardly, is equal to or greater than 10% of the radial distance between the center of the milling tool carrier and the outer diameter of the working surfaces.

In another variation of the second embodiment, the base surfaces have one of a substantially annular shape and the shape of a ring segment.

In a further variation of the second embodiment, the base surfaces have a substantially truncated cone shape.

In a differing variation of the second embodiment, the height of the raised areas, above the base surfaces of the milling tools, is between 2 and 20 mm, and preferably between 2 and 8 min.

In yet another variation of the second embodiment, the width of the raised areas of the milling tools is between 3 and 30 mm.

In still a further variation of the second embodiment the width of the channel shaped slots, between the raised areas of the milling tools, is between 8 and 20 mm.

A further embodiment of this invention includes longer and shorter radially extending raised areas, wherein shorter ones of the radially extending raised areas, are part of the movable working surfaces, or part of two complementary working surfaces.

In the grinding devices of this invention, for grinding or comminuting of fibrous materials, energy is utilized more efficiently. Tests have determined that not only is the increase in the degree of fineness achieved more economically, but also the grinding is achieved with relatively effective preservation of fiber lengths and fiber strength. The evaluation oft he milling effect, as already previously noted, always emanates from the previously obtainable grinding developments, thus it is not generally feasible or useful to set forth firm numerical values. Investigations of the object of this invention however have always shown a significant reduction of the amount of energy required without necessitating a loss of the fiber quality.

A substantial innovation, in comparison with the state of the art, resides in the improved flow control of the fibrous suspension stream through the aperture between the rotor and stator. At the exit of the suspension from the knife region of the milling device an initial or first rotational zone is provided which axially bounds or abuts the rotor in which however, on at least one side, no further webs or fillets are utilized. No grinding takes place in this annular zone. While this phenomenon is not fully understood, a possible reason for the better economy or efficiency is the increased backflow of the suspension, that is radially inwardly, from this annular region. As is well known, this will improve the grinding result in particular, the grinding is more uniform.

The noted annular zone, as defined in the appended claims, is formed either radially outwardly of the actual milling or grinding tools, or in the radial outer zone of the milling tools themselves.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the characters to the same or analogous components and drawings, there have generally been used the same reference wherein:

FIG. 1 is a schematic sectional side view of a disk refiner of this invention;

FIG. 2 is an enlarged showing of a portion of the stator of FIG. 1;

FIG. 3 is a schematic diagram of the milling development of this invention;

FIGS. 4 to 6 are schematic views of further working embodiments of the milling tools of this invention;

FIG. 7 is a schematic showing of a conical refiner of this invention;

FIG. 8 is a schematic top plan view of a portion of a milling tool of this invention; and FIG. 9 is a schematic top plan view of a portion of a double disk refiner of this invention

DETAILED DESCRIPTION OF THE PREFERRED EMBODIMENTS

With respect to the drawings it is to be understood that only enough of the construction of the invention and the surrounding environment in which the invention is employed have been depicted therein, in order to simplify the illustrations, as needed for those skilled in the art to readily understand the underlying principles and concepts of the invention.

FIG. 1 shows the object of this invention in the form of a disk refiner, showing a portion of a housing 1, a rotor 2 and a stator 3, with the rotor and stator serving as milling or comminution tool carriers. The suspended fiber or fibrous material can be inwardly directed via central inlet opening 5 and outwardly directed via radial outlet opening 6. In the form illustrated in FIG. 1, rotor 2 is fixed against axial movement while stator 3 is axially movable relative to rotor 2, whereby stator 2 is restrained against rotation by a pin 15. Rotor 2 includes a working surface 7 and stator 3 has a complementary further working surface 8, with a milling aperture 9 being formed between these two working surfaces. The regions of workings surfaces 7, 8 are provided with ledge shaped raised areas 10 on rotor 2 and ledge shaped raised areas 11 on stator 3. The FIG. 1 showing is such that ledge shaped raised areas 10 and 11 are shown sectioned above the axis of rotation and not sectioned below the axis of rotation. It can readily be determined that, on both sides of milling aperture 9, ledge shaped raised areas 10 and 11 extend radially outwardly to a lesser extent than the rotor and the stator, FIG. 2 is an enlarged showing of a portion of the stator 3 of FIG. 1 wherein a portion of stator 3 extends radially outwardly with a dimension or distance a, of at least 30 mm, that is greater than the radial extent of ledge shaped raised areas 11. The lesser extent a which the raised areas 10 or 11 of the working surf does extend radially outwardly can also be equal to or greater than 10% of the radial distance between the center of the milling tool carriers and the outer diameters of working surfaces 7,8. Raised area 11 is a part or portion of the milling tool whose base surface or area also extends for distance a beyond the outermost radial extent of raised area 11. FIG. 2 also shows raised area 11 as having a height or thickness c above base area 14 of the milling tool. Thickness c ranges from 2 to 20 mm and preferably ranges from 2 to 8 mm.

FIG. 3 is a schematic diagram which shows the milling development or generation M in dependence of the utilized milling energy E. The current state of the art milling generation is depicted by curve A2, while curve A1 depicts the more rapid milling generation achieved by means of this invention. It should be self evident that the qualitative values depend greatly upon the utilized raw materials and that this diagram serves merely to elucidate the obtainable advantages.

FIGS. 4 and 5 are schematic fundamental showings of further working embodiments of a disk refiner. The shorter extent of the ledge shaped raised areas can be utilized on the stator side (FIG. 4), on the rotor side (FIG. 5) or, as already shown in FIG. 1, on both sides. FIG. 6 differs from the FIG. 5 showing in that not only the actual ledge shaped raised area 10, but also the grinding tool itself has a lesser outer diameter than its associated rotor. Again, it should be self evident that the principle shown in FIG. 6 can also be utilized in the other combinations as per FIGS. 1, 4 or 5.

Even if the utilization of this invention is particularly significant in disk type roller malls or in roller milling tools associated therewith, the advantages thereof can to a degree also be achieved in conical refiners, particularly steep angle tapered conical or truncated cone refiners.

FIG. 7 is a s the schematic showing of a truncated cone conical refiner, in which the raised areas 10 that form the working surface of rotor 2 extend outwardly to a lesser extent, as per measurement a, than the rotor itself and raised areas 11 of stator 3. Measurement a is measured radially outwardly along the conical working surface.

FIG. 8 is a schematic top plan view of a typical working surface of a disk refiner having a plurality of differing shaped raised areas 10 of a width b, in the range of 3 to 30 mm, and being separated via channel type grooves or slits 12, with dimension or distance a also being illustrated. The width of these slits or slots is preferably between 8 and 20 mm. As is usual, the complementary working surface, in view of the raised areas, is generally of the same design or pattern, wherein for the existence or presence of dimension a, the description relative thereto in FIGS. 1 and 4–6, is applicable. The complementary working surface could also be totally different, for example, having other knife angles or have hubs, burls or a circular cut pattern.

Another working embodiment of the object of this invention is schematically shown in FIG. 9 as a double disk refiner. Rotor 2 is provided with working surfaces on both sides thereof, together with two stators 3 which include complementary working surfaces. Double or twin disk refiners and their associated charging or loading systems are known to those skilled in the art relative to their construction and operation. It is important, in conjunction with the present invention, that ledge shaped raised areas 10 and/or 11 extend to a lesser dimension than that of stator 3 or rotor 2. Already previously defined measurement c, also shown in FIG. 9, illustrates the height or extent of the upper surface of ledge shaped raised area 10 above base surface 13.

While there are shown and described present preferred embodiments of the invention, it is to be distinctly understood that the invention is not limited thereto, but may be otherwise variously embodied and practiced within the scope of the following claims and the reasonably equivalent structures thereto. Further, the invention illustratively disclosed herein may be practiced in the absence of element which is not specifically disclosed herein.

What is claimed is:

1. A roller mill for the milling of a fibrous material suspension, the roller mill comprising:

a housing having inlet and outlet openings for the fibrous material suspension;

at least two complementary milling tool carriers, including a rotor and a stator, for the attachment of milling tools for establishing at least one working surface and a complementary additional working surface, with the working surfaces being positioned, relative to each other, so as to define a milling aperture through which the fibrous material suspension flows during the operation of the roller mill;

at least one of the working surfaces including a plurality of raised areas acting as cutting edges and having channel shaped grooves therebetween, so that the fibrous material suspension is at least partially directed through the channel shaped grooves from the inside to the outside thereof, with a mechanical working of the fibrous material suspension being achieved via the relative motion between the two complementary working surfaces; and on at least one side of the milling aperture, the raised areas of the at least one working surface extending radially outwardly at least 30 mm less than the extent of its associated milling tool carrier, thus producing a region in which the fibrous material suspension achieves a higher unit pressure and enables a reverse radial flow of the fibrous material back into the stator.

2. The roller mill of claim 1, wherein the lesser extent which the raised areas of the at least one working surface extend radially outwardly, is equal to or greater than 10% of the radial distance between the center of the associated milling tool carrier and the outer diameter of the at least one working surface.

3. The roller mill of claim 2, wherein the raised areas include longer and shorter radially extending raised areas, with the shorter ones of the radially extending raised areas, being parts of movable working surfaces.

4. The roller mill of claim 2, longer and shorter radially extending raised areas, with the shorter ones of the radially extending raised areas, being parts of two complementary working surfaces.

5. The roller mill of claim 2, wherein the mutually complementary milling tool carriers are substantially disk shaped.

6. The roller mill of claim 5, wherein the raised areas include longer and shorter radially extending raised areas, with the shorter ones of the radially extending raised areas, being parts of movable working surfaces.

7. The roller mill of claim 5, longer and shorter radially extending raised areas, with the shorter ones of the radially extending raised areas, being parts of two complementary working surfaces.

8. The roller mill of claim 1, wherein the mutually complementary milling tool carriers are substantially disk shaped.

9. The roller mill of claim 8, wherein the raised areas include longer and shorter radially extending raised areas, with the shorter ones of the radially extending raised areas, being parts of movable working surfaces.

10. The roller mill of claim 8, longer and shorter radially extending raised areas, with the shorter ones of the radially extending raised areas, being parts of two complementary working surfaces.

11. The roller mill of claim 1, wherein the raised areas include longer and shorter radially extending raised areas, with the shorter ones of the radially extending raised areas, being parts of movable working surfaces.

12. The roller mill of claim 1, longer and shorter radially extending raised areas, with the shorter ones of the radially extending raised areas, being parts of two complementary working surfaces.

* * * * *